US011864633B2

(12) United States Patent
Moody

(10) Patent No.: US 11,864,633 B2
(45) Date of Patent: Jan. 9, 2024

(54) SEATBELT BUCKLE COVER

(71) Applicant: Dolores Moody, Mesa, AZ (US)

(72) Inventor: Dolores Moody, Mesa, AZ (US)

( * ) Notice: Subject to any disclaimer, the term of this patent is extended or adjusted under 35 U.S.C. 154(b) by 0 days.

(21) Appl. No.: 18/076,080

(22) Filed: Dec. 6, 2022

(65) Prior Publication Data

US 2023/0354966 A1 Nov. 9, 2023

Related U.S. Application Data

(60) Provisional application No. 63/339,680, filed on May 9, 2022.

(51) Int. Cl.
*A44B 11/00* (2006.01)

(52) U.S. Cl.
CPC ..... *A44B 11/003* (2013.01)

(58) Field of Classification Search
CPC ..... A44B 11/003; Y10T 24/45602; Y10T 24/45607; Y10T 24/45613; Y10T 24/45618; Y10T 24/45628
See application file for complete search history.

(56) References Cited

U.S. PATENT DOCUMENTS

| | | | | |
|---|---|---|---|---|
| 4,939,824 | A * | 7/1990 | Reed | A44B 11/2576 24/579.11 |
| 4,944,530 | A * | 7/1990 | Spurrier | A44B 11/2576 280/808 |
| 4,961,251 | A * | 10/1990 | Smith | A44B 11/2576 24/633 |
| 6,138,331 | A * | 10/2000 | Powers | A44B 11/2576 24/306 |
| 9,439,479 | B1 * | 9/2016 | Vu | A44B 11/2576 |
| 2008/0179936 | A1 * | 7/2008 | Mirmikidis | B64D 11/062 297/482 |

* cited by examiner

*Primary Examiner* — Robert Sandy
(74) *Attorney, Agent, or Firm* — Accelerate IP LLC

(57) ABSTRACT

A seatbelt buckle cover for a seatbelt having a handle and a latch extending from the handle, the seatbelt buckle cover comprising a handle cover having a top, a bottom, and a handle cover front section coupled to a handle cover back section. A latch cover having at least one of a latch cover front section and a latch cover back section, the latch cover extending from the bottom of the handle cover. A first section and a second section at least partially splitting the handle cover front section, wherein the first section and the second section are removably attached to each other. A slot at the bottom of the handle cover allowing the latch to pass through the handle cover.

20 Claims, 5 Drawing Sheets

SEATBELT BUCKLE COVER

REFERENCE

This application claims benefit from currently U.S. Provisional Application No. 63/339,680 titled "Seatbelt Buckle Cover" and having a filing date of May 9, 2022, all of which is incorporated by reference herein.

TECHNICAL FIELD

The present specification relates to a seatbelt, more particularly a cover for a seatbelt buckle.

BACKGROUND

Seatbelts have long been used in automobiles. They are necessary in helping to ensure the safety of the passengers and driver within the automobile. Seatbelts typically have a metal latch, a metal handle that is covered with a plastic, a belt, and a buckle. The use of seatbelts is required by law in many areas. Seatbelts are a great safety device, however, in warm climates the seatbelt can become a burn hazard. In many areas, like the southwest, intense sun can raise an automobile's interior temperature to 140 degrees Fahrenheit or more. Specifically in Phoenix, Arizona when the weather is 110 degrees, an automobile interior can reach 160 degrees.

As the automobile interior heats up, so does the seatbelt, especially the metal parts. While this can be hazardous for anyone, it can be especially hazardous to young children and babies. Young children do not always take into consideration the temperature of the seatbelt before grabbling it, nor are young children careful to avoid direct contact between the seatbelt and their skin. Human skin can sustain a first-degree burn at 118 degrees Fahrenheit, a second-degree burn at 131 degrees Fahrenheit, and can be destroyed at 162 degrees Fahrenheit. First and second-degree burns are likely to be sustained when there is direct contact between the skin and the seatbelt on a hot day. In 2018 nearly one million Arizonans suffered severe burns caused by seatbelts.

To prevent burns a washcloth or other fabric can be wrapped around the handle and latch. However, the washcloth can shift around while riding in the car, exposing the skin to the seatbelt. Since the washcloth is not secured to the seatbelt, it can also be misplaced, lost, or forgotten. The washcloth can slip while getting buckled, especially when an adult is assisting a child.

Therefore, there is a need for a covering that goes over a seat belt buckle that can help prevent the user from being burned by the buckle.

SUMMARY

Accordingly, the seatbelt buckle cover has been made in view of the above-mentioned disadvantages occurring in the prior art. Some advantages of the seatbelt buckle cover are that it optimally covers the seatbelt buckle to exponentially reduce the likelihood of a burn occurring. The seatbelt buckle cover fastens securely to the seatbelt where it can remain secured until removal is desired without interfering with the seatbelt's function, providing safety by ensuring it will not be used incorrectly, forgotten and/or lost. It can also encourage use with its aesthetically pleasing appearance with multiple designs and fabrics that can coincide with a vehicle's theme.

A seatbelt buckle cover for a seatbelt having a handle and a latch extending from the handle, the seatbelt buckle cover can comprise a handle cover having a top, a bottom, and a handle cover front section coupled to a handle cover back section. A latch cover can have at least one of a latch cover front section and a latch cover back section, the latch cover extending from the bottom of the handle cover. A first section and a second section at least partially splitting the handle cover front section, wherein the first section and the second section are removably attached to each other. A slot at the bottom of the handle cover can allow the latch to pass through the handle cover. The handle cover and latch cover generally form a T-shape. The handle cover further comprises a third section and a fourth section, wherein the third section and the fourth section are removably attached to each other.

The front is coupled to the back with at least one of adhesive, fabric glue, stitching, sewing, rivets, heat pressing, and lashing. The first section can be removably attached to the second section using at least one of a zipper, hook and loop, snaps, ties, and clips. The handle cover and the latch cover can be comprised of different materials. The handle cover and the latch cover can be integral. The front and back are comprised of at least one of heat resistant material, polymer, silicon, food grade silicon, canvas, webbing, cotton, wool, nylon, auto interior fabric, hemp, cork, rattan, foil, terry cloth, recycled materials, felted materials, knit materials, and woven materials. The latch cover can be one of generally rectangular, generally pentagonal, and generally hexagonal. The latch cover can be configured to conform to the shape of the latch. The handle cover can be configured to conform to the shape of the handle. The at least one of the handle cover shape, the latch cover shape, the materials, and the color is customizable.

A method of making a seatbelt buckle cover for a seatbelt having a handle and a latch extending from the handle, the steps comprising providing a handle cover comprised of a handle front section and a handle back section. Providing a latch cover extending from the handle cover forming a general T-shape with the handle cover. Forming a slot in the handle cover to allow the latch to pass through the bottom of the handle cover. Forming a first section and a second section in the handle cover splitting the handle cover front section, wherein the first section and the second section are removably attached to each other.

The method of making a seatbelt buckle cover comprising at least one of the following steps: obtaining the shape of the desired latch and configuring the latch cover to conform to the desired latch shape; obtaining a desired color and coloring the at least part of the handle cover and the latch cover to match the desired color; obtaining the desired shape of the handle and configuring the handle cover to conform to the desired shape of the handle cover. The desired latch shape, desired color, and desired shape of the handle are obtained from a user. The handle cover further comprises a third section and a fourth section, wherein the third section and the fourth section are removably attached to each other. The front is coupled to the back with at least one of adhesive, fabric glue, stitching, sewing, rivets, heat pressing, and lashing. The first section is removably attached to the second section via at least one of a zipper, hook and loop, snaps, ties, and clips. The handle cover and the latch cover are comprised of different materials. The handle cover and the latch cover can be integral.

BRIEF DESCRIPTION OF THE DRAWINGS

These and other features, aspects, and advantages of the present specification will become better understood with regard to the following description, appended claims, and accompanying drawings where:

DETAILED DESCRIPTION

Figure 1:
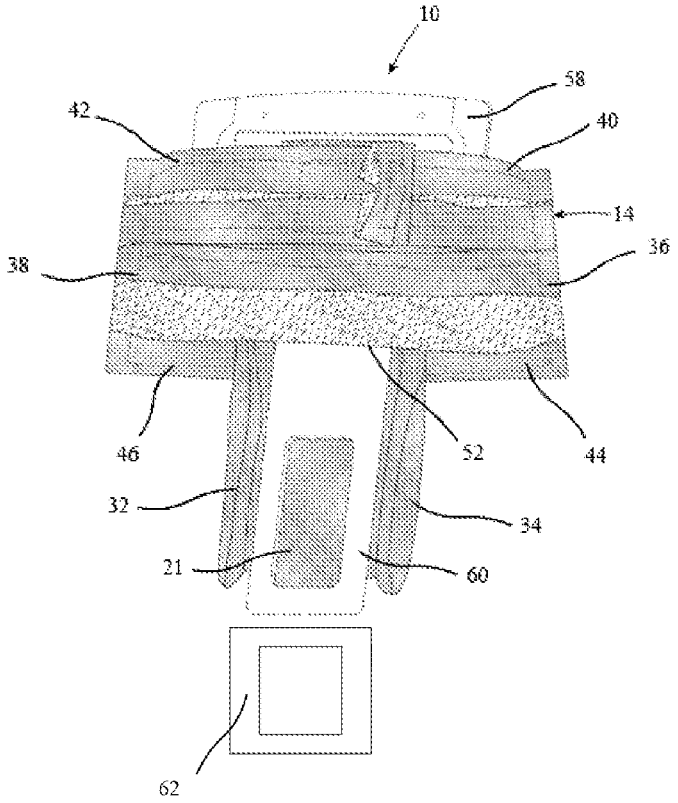
FIG. 1 is back view of a seatbelt buckle cover, in accordance to one, or more embodiments.
Figure 2:
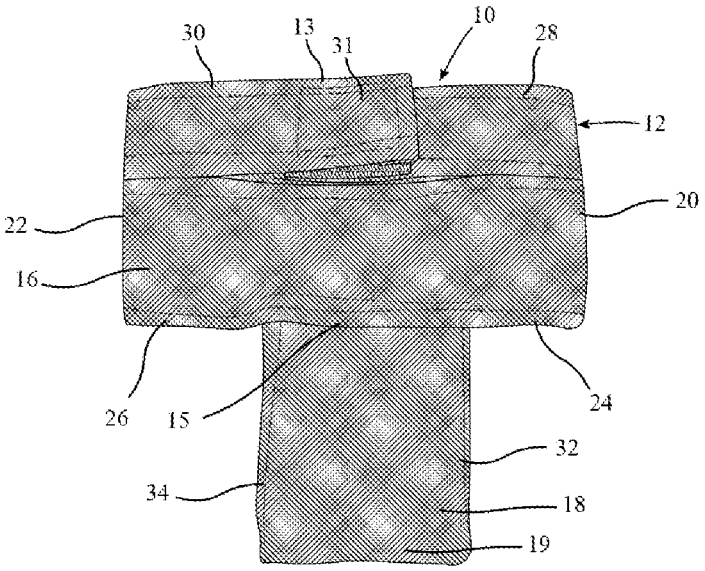
FIG. 2 is a front view of a seatbelt buckle cover, in accordance to one, or more embodiments.
Figure 3:
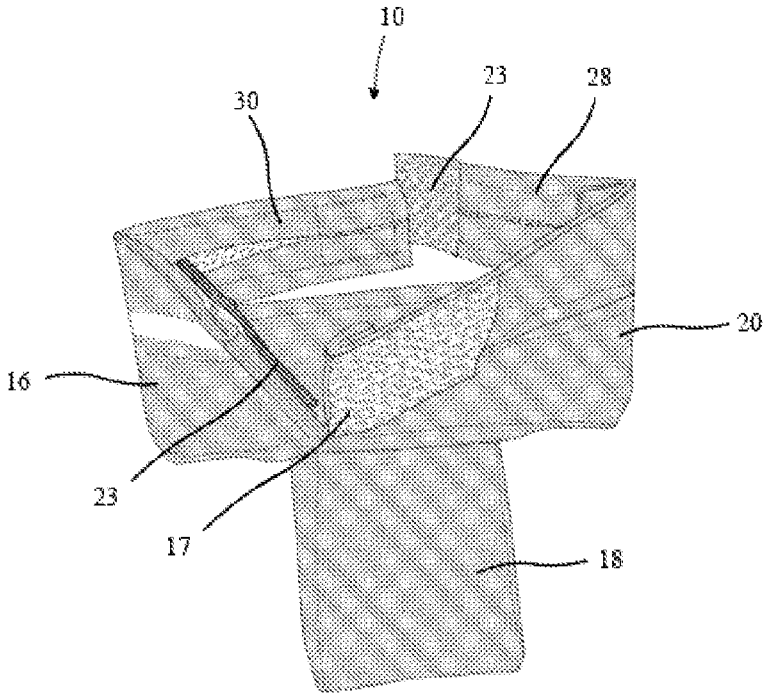
FIG. 3 is a front view of a seatbelt buckle cover in its open state, in accordance to one, or more embodiments.

Referring initially to FIGS. 1-3, a seatbelt buckle cover shown generally at for a seatbelt having a handle, wherein the seatbelt buckle comprises a handle cover 16 having a top 13, a bottom 15, and a handle cover front section 12 coupled to a handle cover back section 14. The front section 12 and the back section 14 can be any suitable shape that can cover a seatbelt handle 58 and latch 60, preferably the front section can be generally squared, triangular, t-shaped, or the like. The front section 12 and the back section 14 can comprise any suitable material that is at least partially heat resistant, such as, a polymer, silicon, food grade silicon, canvas, webbing, cotton, wool, nylon, auto interior fabric, hemp, cork, rattan, foil, terry cloth, recycled materials, felted materials, knit materials, woven materials, neoprene or the like. The front section 12 and the back section 14 can be coupled together to form a handle cover 16.

A latch cover 18 can have at least one of a latch cover front section 19 and a latch cover back section 21, wherein the latch cover extending from the bottom 15 of the handle cover 16. The front section 12 can have a latch cover 18 extending from the handle cover 16 wherein the handle cover and the latch cover 18 can be coupled, or they can be integral, comprised of the same materials, or different materials. The handle cover 16 can have a first side 20, a second side 22, a first center side 24, a second center side 26 and the latch cover 18 which can have a latch first side 32, and a latch second side 34. The front section 12 can have a first section 28 and a second section 30 that can at least partially split the handle cover front section into two sections, wherein the first section and the second section can partially overlap each other and are removably attached to each other. The handle cover's 16 back section 14 can have a third section 40 and fourth section 42 that can partially split the back section, wherein the third section and the fourth section can partially overlap each other and be removably attached to each other. The first section 28 and the second section 30, and the third section 40 and fourth section 42 can be removably or permanently coupled to each other at a first attachment point 23 and a second attachment point 17 which can be such as, for example, a hook and loop, snap, button, adhesive, or the like. The first section 28 and second section 30 can provide a slot 52 for the seatbelt handle to enter the seatbelt cover and then tighten around the seatbelt handle. The slot at the bottom 15 of the handle cover 16 allowing the latch 60 to pass through the handle cover. The handle cover 16 and latch cover 18 can generally form a T-shape.

Figure 4:
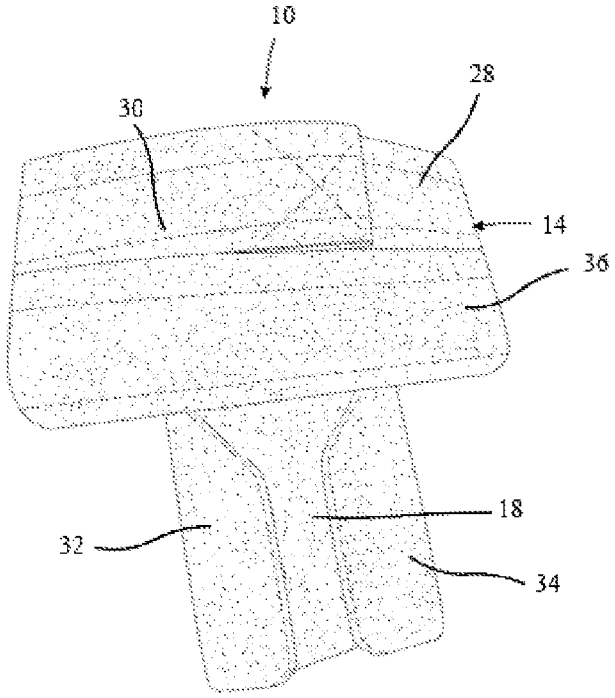
FIG. 4 is a back view of another embodiment of a seatbelt buckle cover, in accordance to one, or more embodiments.

In embodiments, the handle cover 16 back section 14 or the front section 12 can have a first section 28 and second section 30, or the third section 40 and the fourth section 42 omitted wherein only one of the back section or the front section has its first section and second section or third section or fourth section as shown in FIG. 4.

In embodiments, the latch cover 18 can extend from the front section 12 covering the entire latch or partially covering the latch and can allow the user to easily access the seat belt buckle release button. The latch first side 32 and the latch second side 34 can partially or fully surround the latch 60 as shown in FIG. 1 and FIG. 4. The latch cover 18 can be made from the same material as the front section 12 and the back section 14 or it can be a different material such as, for example, a polymer, silicon, food grade silicon, canvas, webbing, cotton, wool, nylon, auto interior fabric, hemp, cork, rattan, foil, terry cloth, recycled materials, felted materials, knit materials, woven materials, neoprene or the like.

The back section 14 can comprise a first side 36, a second side 38, a back first section 40, a back second section 42, a first back side 44, and a second back side 46. The front section and back section can be coupled together around its outer perimeter of its outer sides and partially along the back and front section back keeping a hole in the center for the latch 60 creating a latch slot 52 or in at least one of the following such as, for example, the front first side 20 can be coupled to the back first side 36, the front second side 22 can be coupled to the back second side 38, the front first center side 24 can be coupled to the back first center side 40, the front second center side 26 can be coupled to the back second center side 42, the front first back side 28 can be coupled to the back first back side 44, the front second back side 30 can be coupled to the back second back side 46, the latch first side 32 can be coupled to the back latch first side 48, the latch second side 34 can be coupled to the back latch second side 50.

In certain embodiments, the seatbelt buckle cover 10 can have at least one side that can be coupled using a device, such as, adhesive, fabric glue, stitching, sewing, rivets, heat pressing, lashing, or the like. The sides can be coupled with a removable device, such as, zipper, hook and loop, snaps, ties, clips, or the like or the sides can remain uncoupled. The sides can be uncoupled and/or coupled in any combination thereof. The sides can be coupled using any combination of non-removable and removable devices. A combination of non-removable and removable devices can be used. For example, the front first center side 24 can be glued to the back first center side 40 and the front second center side 26 can be glued to the back second center side 42. The front first side 20, first back side 28, second back side 30, second side 22, can have a strip of hook and loop material secured to them, and the back first side 36, first back side 44, second back side 46, second side 38 can have a strip of corresponding hook and loop material secured to them, which can allow for easy installation of the seatbelt buckle cover over a seatbelt buckle.

The non-removable coupling keeps the front section 12 and back section 14 pieces together making them easier to manipulate and helps prevent them from getting lost. The removable coupling allows for easy manipulation of the cover 10 around the belt 56. In this example, the cover 10 can be installed by inserting the latch 58 into the latch slot 52, manipulating the belt 56 through the belt slot 54 on the front 12, manipulating the belt 56 through the belt slot 54 on the back 14, and securing the hook and loop along the front 12 sides 20, 28, 30, and 22 to the corresponding hook and loop along the back section 14 sides. The cover 10 can optimally cover the handle 58 and latch 60, preventing burns without adding bulk which can make the seatbelt uncomfortable. It can also allow the seatbelt to still function properly by leaving the latch easily accessible.

In other embodiments the front section 12 can be glued to the back section 14 first side 36, the front first center side 24 can be glued to the back first center side 40, the latch first side 32 can be glued to the bottom latch first side 48, forming a pocket. In this example the seat belt cover 10 can be installed by sliding the handle 58 into the pocket. The belt slot 54 is omitted, and the first back sides 28 and 44, and the second back sides 30 and 46 remain open.

In certain embodiments, an insulative layer (not shown) can align the inside layer or outside layer of the seatbelt buckle cover 10. The insulative layer can be made from such as, for example, insulative fiber, insulative ceramic fiber, mineral wool, foam, cotton batting, or the like. The insulative layer can be coupled to the seatbelt buckle 10 the non-removable or removable device as mentioned above. The insulative layer can take on the substantially same shape as the front section 12 and the back section 14 wherein the insulative later can go between the inside of the front and back or it can go on the outside of the front and back. The insulative layer adds another layer of protection from the heat of the seatbelt buckle.

In certain embodiments the latch cover 18 can be comprised of flexible thin materials. The latch first side 32 can be coupled to the bottom latch first side 40, and the latch second side 34 can be coupled to the bottom latch second side 42. The latch cover 18 can be scrunched up towards the handle cover 16 to allow the latch to be exposed and to couple with the buckle properly. In other embodiments the latch first side 32 can be removably coupled to the a bottom latch first side, and the latch second side 34 can be removably coupled to a bottom latch second side. The sides can be uncoupled to allow the latch 60 to be exposed and to couple with the buckle 62 properly.

In one or more embodiments the cover 10 can be customized. The handle cover 16 can conform to the shape of a desired handle, and the latch cover 18 can conform to the shape of a desired latch. The cover 10 can be comprised of desired materials. In at least one embodiment, the cover 10 can be comprised of materials that are the same color as a desired car's interior. In at least one embodiment, the cover 10 can be comprised of the same fabric as the desired car's interior.

Figure 5:
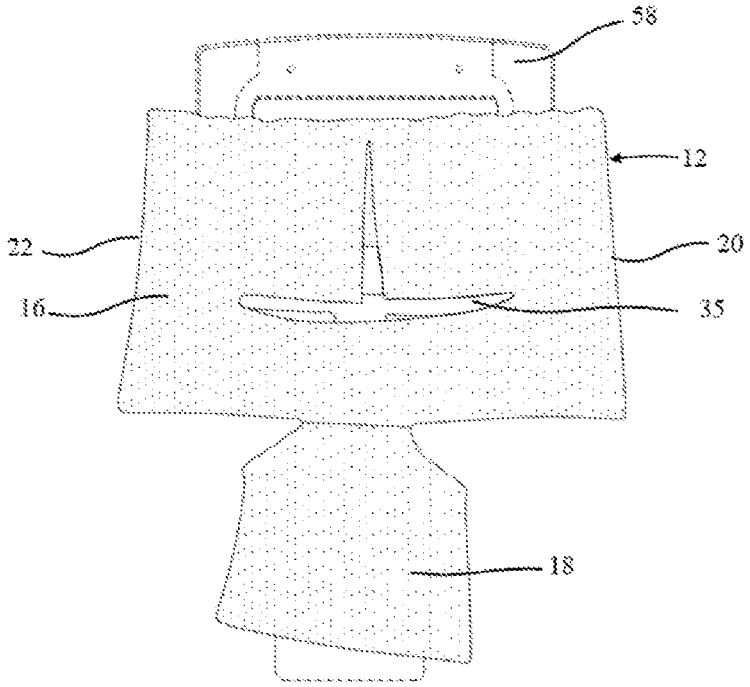
FIG. 5 is a front view of another embodiment of a seatbelt buckle cover, in accordance to one, or more embodiments.
Figure 6:
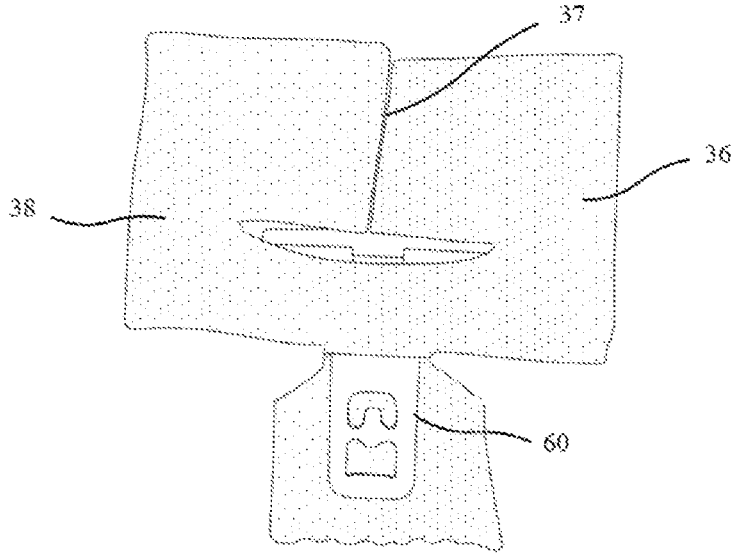
FIG. 6 is a back view of another embodiment of a seatbelt buckle cover, in accordance to one, or more embodiments.

As shown in FIG. 5-6 another embodiment of the seatbelt buckle cover 10 the first section and the second section can be omitted and the handle cover can have a top, a bottom and a handle cover front section coupled to a hand cover back section. A latch cover having at least one of a latch cover front section and a latch cover back section, the latch cover extending from the bottom of the handle cover. A slot at the bottom of the handle cover allowing the latch and/or belt slot to pass through the handle cover.

Figure 7:
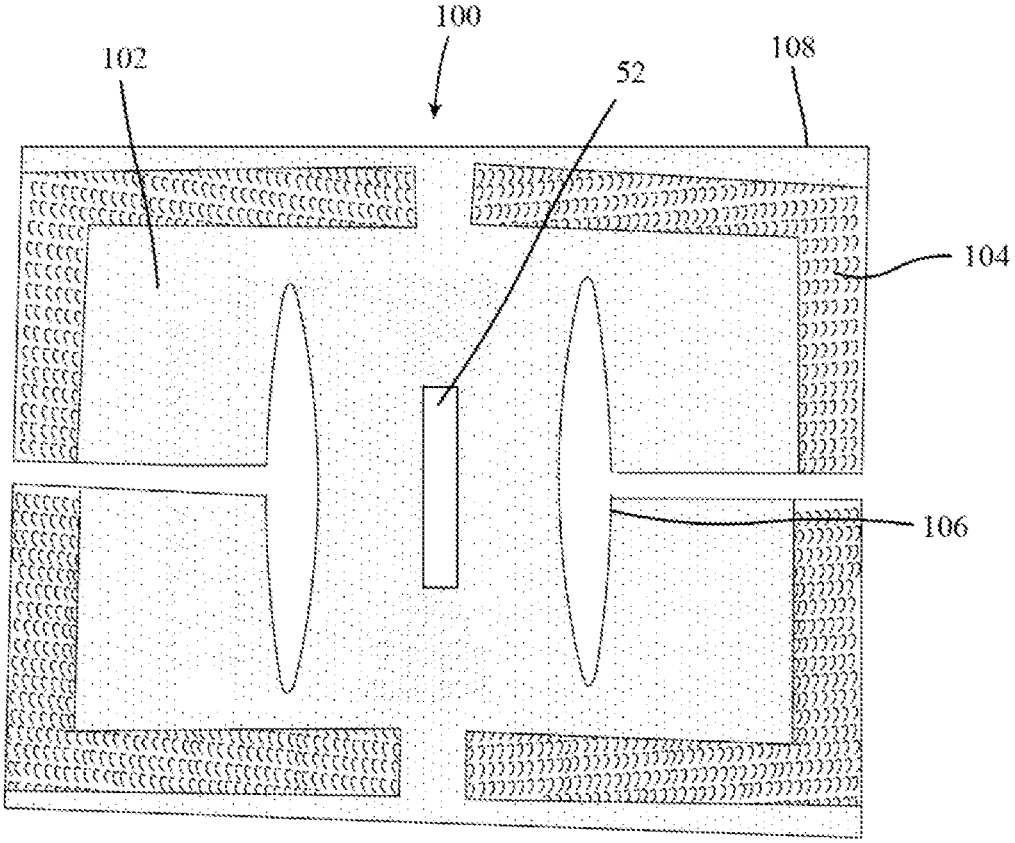
FIG. 7 is a top view of another embodiment of a seatbelt buckle cover in its open state, in accordance to one, or more embodiments.
Figure 8A:
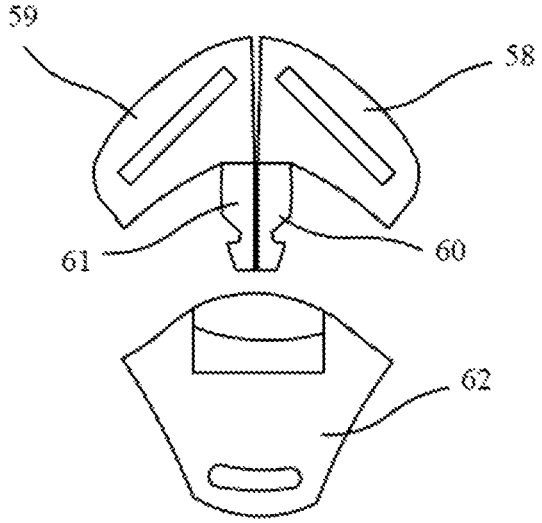
FIG. 8*a* is a front view of example child car seatbelt buckle, in accordance to one, or more embodiments.
Figure 8B:
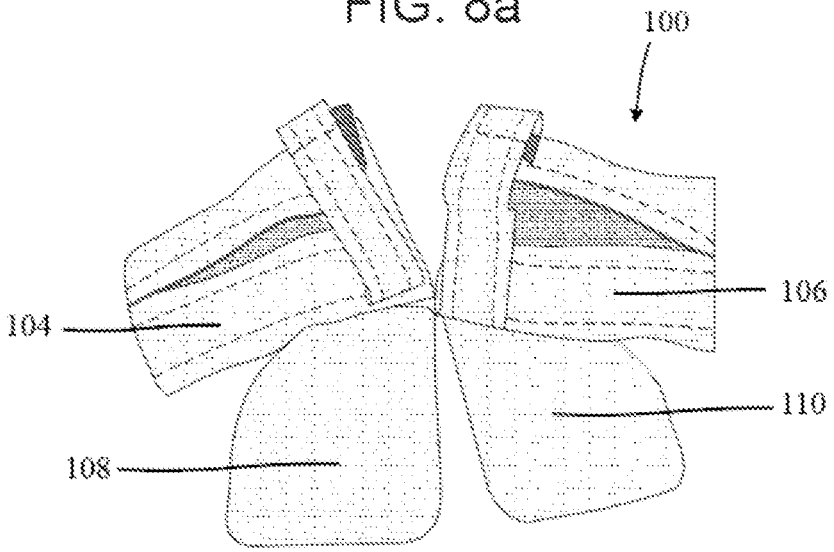
FIG. 8*b* is a front view of another embodiment of a child car seatbelt buckle cover, in accordance to one, or more embodiments.

Referring now to FIG. 7 another embodiment the seatbelt buckle cover 100 can comprise front (not shown) and a back 102 wherein a slot 52 can be substantially centered and through the back and the front. The back 102 can have at least one attachment point 104 wherein the back can be folded over onto itself wherein at least one second slot 106 can accommodate a seatbelt buckle.

Referring now to FIG. **8*a*-8*b* shows a child seat belt buckle having two latch sections 60, 61, and two handle section 58, 59. In certain embodiments the seatbelt buckle cover 100 can comprise a handle having at least two sections 104, 106 wherein at least two sections can have a top, a bottom, and a handle cover front section coupled to a handle cover back section. A latch cover having two sections 108, 110 wherein the latch cover has at least one of a latch cover front section and a latch cover back section, the latch cover extending from the bottom of the handle cover. The handle at least two sections 104, 106 and the latch at least two sections 108, 110 can be removably attached to each other by such as, for example, hook and loop, snap, button, adhesive, or the like. The child seat belt buckle can have at least two slots at the bottom of the handle cover allowing the latch to pass through the at least two sections of the handle cover. The seatbelt buckle cover 100** can completely cover or partially cover both sides of the baby car seat buckle, or partially or fully cover the metal portion of the buckle.

A method of making a seatbelt buckle cover 10 for a seatbelt having a handle 58 and a latch 60 extending from the handle, as shown in FIG. 1, the steps comprising providing a handle cover 16 comprised of a handle front section and a handle back section. Providing a latch cover 18 extending from the handle cover forming a general T-shape with the handle cover. Forming a slot in the handle cover to allow the latch to pass through the bottom of the handle cover. Forming a first section and a second section in the handle cover splitting the handle cover front section, wherein the first section and the second section are removably attached to each other.

The method of making a seat belt buckle cover comprising at least one of the following steps: (1) obtaining the shape of the desired latch and configuring the latch cover to conform to the desired latch shape; (2) obtaining a desired color and coloring the at least part of the handle cover and the latch cover to match the desired color; (3) obtaining the desired shape of the handle and configuring the handle cover to conform to the desired shape of the handle cover. The desired latch shape, desired color, and desired shape of the handle are obtained from a user. The handle cover further comprises a third section and a fourth section, wherein the third section and the fourth section are removably attached to each other. The front is coupled to the back with at least one of adhesive, fabric glue, stitching, sewing, rivets, heat pressing, and lashing. The first section is removably attached to the second section via at least one of a zipper, hook and loop, snaps, ties, and clips. The handle cover and the latch cover are comprised of different materials. The handle cover and the latch cover are integral.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only and is not intended to limit the scope of the present disclosure, which is defined solely by the claims. Accordingly, embodiments of the present disclosure are not limited to those precisely as shown and described.

Certain embodiments are described herein, including the best mode known to the inventors for carrying out the methods and devices described herein. Of course, variations on these described embodiments will become apparent to those of ordinary skill in the art upon reading the foregoing description. Accordingly, this disclosure includes all modifications and equivalents of the subject matter recited in the claims appended hereto as permitted by applicable law. Moreover, any combination of the above-described embodiments in all possible variations thereof is encompassed by the disclosure unless otherwise indicated herein or otherwise clearly contradicted by context.

What is claimed:

1. A seatbelt buckle cover for a seatbelt having a handle and a latch extending from the handle, the seatbelt buckle cover comprising:

a handle cover having a top, a bottom, and a handle cover front section coupled to a handle cover back section;

a latch cover having at least one of a latch cover front section and a latch cover back section, the latch cover extending from the bottom of the handle cover; and a first section and a second section at least partially splitting the handle cover front section, wherein the first section and the second section are removably attached to each other, and a slot at the bottom of the handle cover allowing the latch to pass through the handle cover.

2. The seatbelt buckle cover of claim 1, wherein the handle cover and latch cover generally form a T-shape.

3. The seatbelt buckle cover of claim 1, wherein the handle cover further comprises a third section and a fourth section, wherein the third section and the fourth section are removably attached to each other.

4. The seatbelt buckle cover of claim 1, wherein the latch cover front section is coupled to the handle cover back section with at least one of adhesive, fabric glue, stitching, sewing, rivets, heat pressing, and lashing.

5. The seatbelt buckle cover of claim 1, wherein the first section is removably attached to the second section using at least one of a zipper, hook and loop, snaps, ties, and clips.

6. The seatbelt buckle cover of claim 1, wherein the handle cover and the latch cover are comprised of different materials.

7. The seatbelt buckle cover of claim 1, wherein the handle cover and the latch cover are integral.

8. The seatbelt buckle cover of claim 1, wherein the latch cover front section and handle cover back section are comprised of at least one of heat resistant material, polymer, silicon, food grade silicon, canvas, webbing, cotton, wool, nylon, auto interior fabric, hemp, cork, rattan, foil, terry cloth, recycled materials, felted materials, knit materials, and woven materials.

9. The seatbelt buckle cover of claim 1, wherein the latch cover is one of generally rectangular, generally pentagonal, and generally hexagonal.

10. The seatbelt buckle cover of claim 1, wherein the latch cover is configured to conform to the shape of the latch.

11. The seatbelt buckle cover of claim 1, wherein the handle cover is configured to conform to the shape of the handle.

12. The seatbelt buckle cover of claim 1, wherein the handle cover has a handle cover shape, the latch cover has a latch cover shape, the handle cover is made from a handle cover material, the latch cover is made from a latch cover material, the cover handle has a cover handle color, and latch handle has a latch handle color wherein at least one of the handle cover shape, the latch cover shape, the handle cover material, the latch cover material, the cover handle color, and the latch handle color is customizable.

13. A method of making a seatbelt buckle cover for a seatbelt having a handle with a handle shape and a latch with a latch shape, the latch extending from the handle, the steps comprising:

providing a handle cover comprised of a handle cover front section and a handle back section;

providing a latch cover extending from the handle cover forming a general T-shape with the handle cover;

forming a slot in the handle cover to allow the latch to pass through a bottom of the handle cover;

forming a first section and a second section in the handle cover splitting the handle cover front section, wherein the first section and the second section are removably attached to each other.

14. The method of claim 13, further comprising at least one of the following steps:

obtaining the latch shape to define a desired latch shape and configuring the latch cover to conform to the desired latch shape;

obtaining a desired color and coloring the at least part of the handle cover and the latch cover to match the desired color;

obtaining the handle shape to define a desired handle shape and configuring the handle cover to conform to the desired handle shape.

15. The method of claim 13, wherein the desired latch shape, desired color, and desired shape of the handle are obtained from a user.

16. The method of claim 13, wherein the handle cover further comprises a third section and a fourth section, wherein the third section and the fourth section are removably attached to each other.

17. The method of claim 13, wherein the handle cover front section is coupled to the handle back section with at least one of adhesive, fabric glue, stitching, sewing, rivets, heat pressing, and lashing.

18. The method of claim 13, wherein the first section is removably attached to the second section via at least one of a zipper, hook and loop, snaps, ties, and clips.

19. The method of claim 13, wherein the handle cover and the latch cover are comprised of different materials.

20. The method of claim 13, wherein the handle cover and the latch cover are integral.

* * * * *